US007955097B2

(12) United States Patent
O'Leary et al.

(10) Patent No.: US 7,955,097 B2
(45) Date of Patent: Jun. 7, 2011

(54) PLUG-IN OUTLET (PIO) WITH FLOATING FINGERGUARD

(76) Inventors: Timothy O'Leary, Antioch, TN (US); Wesley Travis, Murfreesboro, TN (US); David Plummer, Nashville, TN (US); David Vick, Lebanon, TN (US)

( * ) Notice: Subject to any disclaimer, the term of this patent is extended or adjusted under 35 U.S.C. 154(b) by 82 days.

(21) Appl. No.: 12/609,431

(22) Filed: Oct. 30, 2009

(65) Prior Publication Data

US 2011/0104916 A1 May 5, 2011

(51) Int. Cl.
*H01R 25/00* (2006.01)

(52) U.S. Cl. ..... 439/114; 174/99 B

(58) Field of Classification Search ..... 439/114, 439/207, 211, 212; 174/99 B, 68.2, 70 B
See application file for complete search history.

(56) References Cited

U.S. PATENT DOCUMENTS

| | | | | | |
|---|---|---|---|---|---|
| 2,124,269 | A | * | 7/1938 | Anderson et al. | 337/191 |
| 2,150,963 | A | * | 3/1939 | De Mask | 361/675 |
| 2,192,587 | A | * | 3/1940 | Harvey | 439/114 |
| 2,720,632 | A | * | 10/1955 | Stieglitz | 439/114 |
| 2,906,811 | A | * | 9/1959 | Fisher | 174/99 B |
| 2,992,401 | A | * | 7/1961 | Lewis | 439/212 |
| 3,099,504 | A | * | 7/1963 | Rowe | 439/114 |
| 3,126,241 | A | * | 3/1964 | Papalas | 439/114 |
| 3,268,848 | A | * | 8/1966 | Adams et al. | 439/114 |
| 3,482,202 | A | * | 12/1969 | Hamilton, Jr. et al. | 439/114 |
| 3,488,621 | A | * | 1/1970 | Stevens | 439/114 |
| 3,922,053 | A | * | 11/1975 | Hafer | 439/114 |
| 4,082,393 | A | * | 4/1978 | Gamble | 439/94 |
| 4,714,431 | A | * | 12/1987 | McGoldrick et al. | 439/212 |
| 5,192,217 | A | | 3/1993 | Wittmer | 439/211 |
| 5,272,591 | A | | 12/1993 | Blue et al. | 361/622 |
| 5,360,349 | A | * | 11/1994 | Provencher et al. | 439/108 |
| 5,415,557 | A | | 5/1995 | Chapman et al. | 439/142 |
| 5,505,630 | A | | 4/1996 | Petrisko et al. | 439/137 |
| 5,519,175 | A | | 5/1996 | Cole | 174/149 B |
| 5,588,852 | A | * | 12/1996 | Puerner | 439/135 |
| 5,619,014 | A | * | 4/1997 | Faulkner | 174/68.2 |
| 5,895,279 | A | | 4/1999 | Petrisko et al. | 439/114 |
| 6,867,373 | B2 | * | 3/2005 | West et al. | 174/101 |

FOREIGN PATENT DOCUMENTS

| | | | |
|---|---|---|---|
| GB | 2 276 779 | A | 10/1994 |
| GB | 2 296 136 | A | 6/1996 |

OTHER PUBLICATIONS

PCT International Search Report for International Application No. PCT/US2010/054606 mailed Jan. 18, 2011 (5 page).
PCT International Written Opinion for International Application No. PCT/US2010/054606 mailed Jan. 18, 2010 (6 pages).

* cited by examiner

*Primary Examiner* — Neil Abrams

(57) ABSTRACT

A plug-in outlet for a busway system has a base mounted to a busway housing, wherein the base has an opening into which an electrical stab extends from a busbar of the busway system. A fingerguard is mounted to the base into the opening and has self-aligning features achieved by built-in tolerances. The fingerguard includes a central barrier for shielding a leading end of the electrical stab, the central barrier extending from side walls of the fingerguard and being separated by respective gaps from a top wall and a bottom wall of the fingerguard. The fingerguard further includes a top back latch and a bottom back latch for attaching the fingerguard to the stab, the top back latch and the bottom back latch extending from respective ones of the top wall and the bottom wall toward the stab and retaining the stab toward the fingerguard.

20 Claims, 6 Drawing Sheets

PLUG-IN OUTLET (PIO) WITH FLOATING FINGERGUARD

FIELD OF THE INVENTION

This invention is directed generally to a busway electrical system, and, more particularly, to a busway having a plug-in outlet (PIO) with a fingerguard protection feature.

BACKGROUND OF THE INVENTION

Busway electrical distribution systems are well known in the art of electrical distribution. Busway systems are comprised of a number of factory assembled sections each including a number of individually insulated generally flat electrical conductors or busbars stacked one upon another and enclosed within a housing which provides protection and support for the busbars. The busway sections include one or more plug-in outlets having a plurality of conductive stabs. In general, the plug-in outlets include openings that are provided through the housing of the busway system at each of a plurality of power tap-off sections to expose conductive material of the busbars for connection with an appropriate connecting jaw. A plug-in unit, which is used to tap off power from the busway, is attached to a base in the plug-in opening by mounting a plurality of jaws to a corresponding stab.

Present busway systems can use improved safety features for protecting an installer from unintentional contact between the installer's fingers and the conductive stabs. What is needed, therefore, is a fingerguard protection feature for a plug-in outlet that addresses the above-stated and other problems.

SUMMARY OF THE INVENTION

In an implementation of the present invention, a plug-in outlet for a busway system has a base mounted to a busway housing, wherein the base has an opening into which an electrical stab extends from a busbar of the busway system. A fingerguard is mounted to the base and floats within the opening thereof to provide self-aligning features over the stab, as achieved by its built-in tolerances. The fingerguard includes a central barrier for shielding a leading end of the electrical stab, the central barrier extending from side walls of the fingerguard and being separated by respective gaps from a top wall and a bottom wall of the fingerguard. The fingerguard further includes a top back latch and a bottom back latch for attaching the fingerguard to the stab, the top back latch and the bottom back latch extending from respective ones of the top wall and the bottom wall toward the stab and retaining the stab toward the fingerguard.

In an alternative implementation of the present invention, a plug-in outlet of a busway system has a plurality of self-aligning fingerguards, wherein the plug-in outlet has a base with openings into which a plurality of electrical stabs extend from respective ones of a plurality of busbars. Each of the fingerguards includes a plurality of walls, including a top wall, a bottom wall, and a pair of side walls, and a barrier extending internally from the side walls, the barrier being curved such that an internal space is formed to receive a leading end of a mounted stab. The fingerguard further includes a top aperture and a bottom aperture, the top aperture separating the barrier from the top wall and the bottom aperture separating the barrier from the bottom wall. A top back latch of the fingerguard extends from the top wall, is angled toward the mounted stab, and is flexible to engage and retain a stab ramp by a snap-fit action. A pair of front latches of the fingerguard engage the base and retain the fingerguard in position relative to the base.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
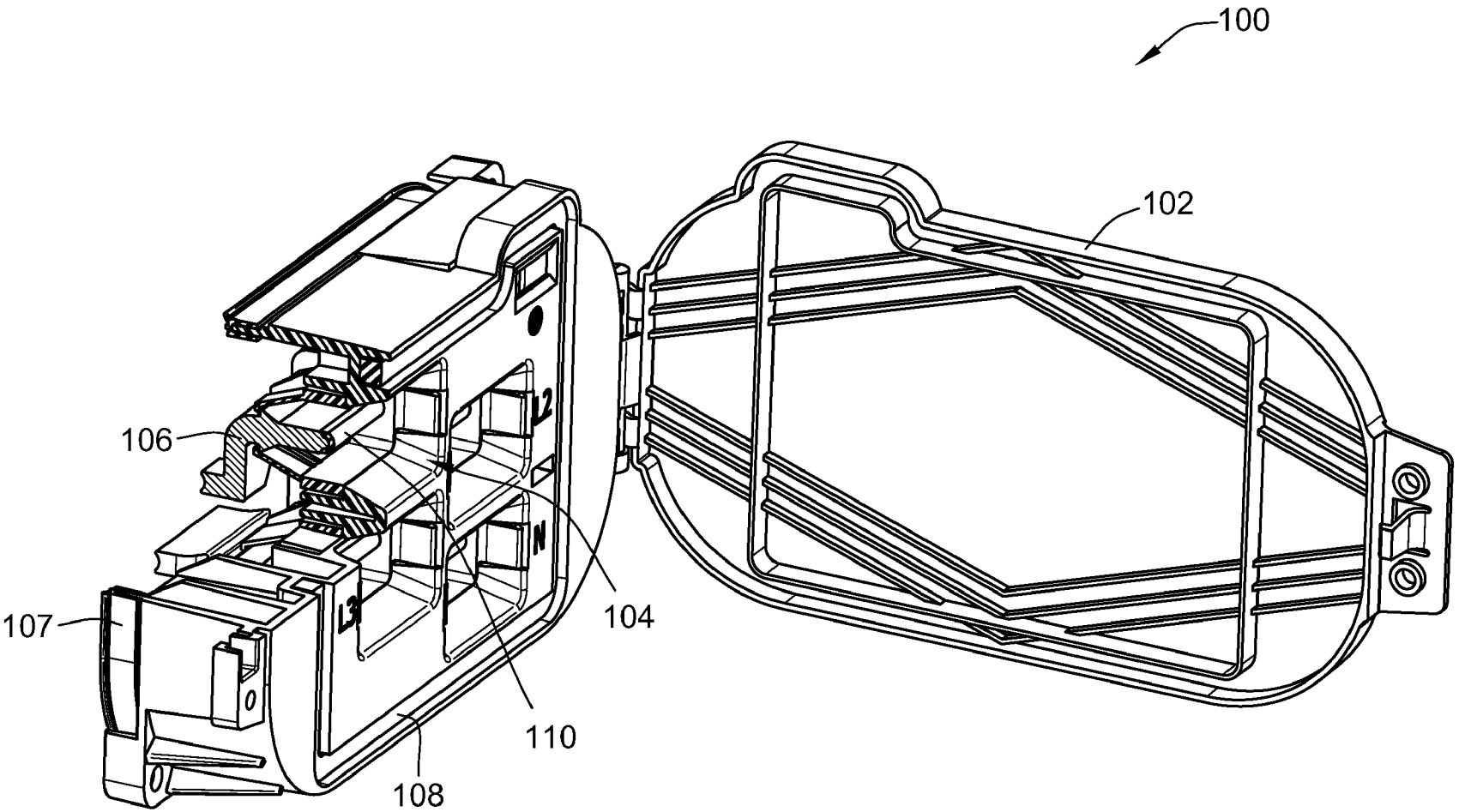
FIG. 1 is a front perspective partial cut-away view of a plug-in outlet with a plurality of stabs and corresponding fingerguards.
Figure 2A:
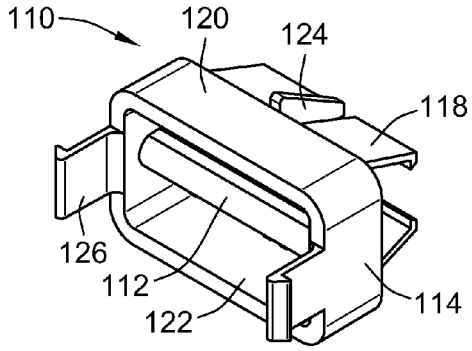
FIG. 2A is a top front perspective view of a fingerguard, according to one embodiment.
Figure 2B:
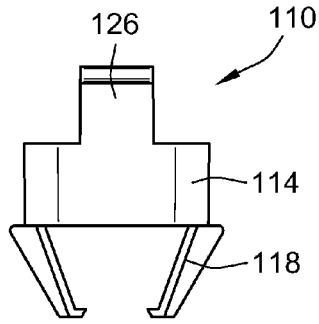
FIG. 2B is a side view of the fingerguard of FIG. 2A.
Figure 2C:
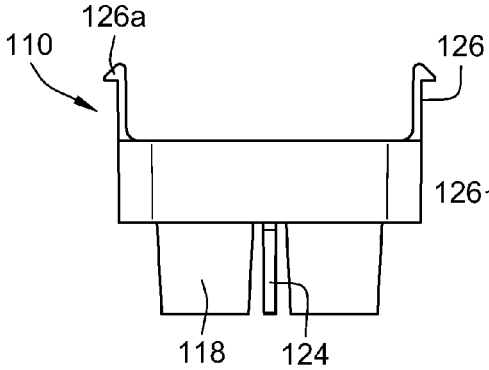
FIG. 2C is top view of the fingerguard of FIG. 2A.
Figure 2D:
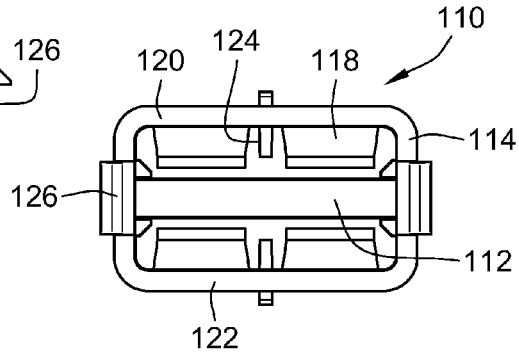
FIG. 2D is a front view of the fingerguard of FIG. 2A.
Figure 2E:
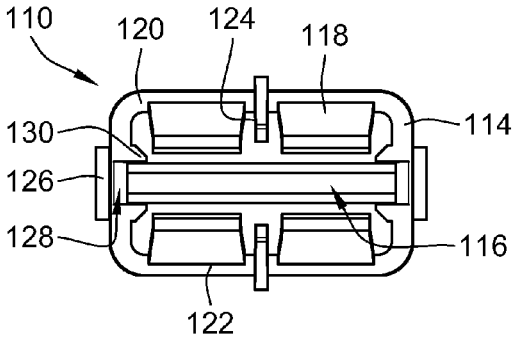
FIG. 2E is a back view of the fingerguard of FIG. 2A.

Referring to FIG. 1, a plug-in outlet base 100 of an electrical distribution busway has a door 102 that provides access for an installer to electrical openings 104 through which busway stabs 106 protrude. When closed, the door 102 prevents ingress of dust and liquids through the openings 104. Optionally, a gasket provides a seal at a gasket base 107 between the plug-in outlet base and a busway housing, and a second gasket provides a seal at a gasket cover 108 between the plug-in outlet base and the door 102

Typically, the stabs 106 are welded to bus bars of the busway and are offset from one another to provide proper electrical clearances. The plug-in outlet base 100 serves as a mounting platform for a plug-in unit that includes a plurality of electrical connectors (or jaws) for inserting into the electrical openings 104.

When mounted, the jaws of the plug-in unit are in electrical contact with corresponding ones of the stabs 106. The stabs 106 are exposed through the openings 104 when the door 102 is opened or removed to install the plug-in unit. To prevent unintentional contact between the installer's fingers and the stabs 106, which may be electrically active if power is not disconnected to the busway before installation is attempted, each of the stabs 106 is protected by a fingerguard 110. As described in more detail below, the fingerguard 110 accommodates position variations of the stabs 106 that are caused by manufacturing clearances and/or thermal expansion.

Referring to FIGS. 2A-2E, the fingerguard 110 has a central barrier 112 extending from two parallel side walls 114. The barrier 112 has a generally arc-shaped cross section with an interior space 116 for receiving a leading end of the received stab 106. The engagement of the fingerguard 110 to the stab 106 and to the plug-in outlet base 100 is described in more detail in reference to FIGS. 4A-6. Based on symmetry of the fingerguard 110, it is understood that reference to a single feature (either in the drawings or in the detailed description) is equally applicable to the corresponding symmetrical feature.

The fingerguard 110 can be formed at least in part from a dielectric plastic material using an injection molded manufacturing process. For example, a candidate material is Zytel® FR50, which is a 25% glass fiber reinforced, flame retardant black polyamide 66 resin for injection molding. Other suitable materials can be also used.

Two pairs of back latches 118 extend respectively from a back end of a top wall 120 and a bottom wall 122. Each pair of the back latches 118 is optionally separated via a center divider 124. The center divider 124 separates the back latches 118 to provide independently moving latches, which further enhance the floating capability of the fingerguard 110 to self-adjust itself based on positional variations of the stab 106. The back latches 118 are designed to engage a ramp (such as ramped ends 402 shown in FIG. 4C) on the received stab 106. Each of the back latches 118 includes a hooked end 118*a* (shown in FIG. 4C) to prevent the fingerguard 110 from moving away from the received stab 106.

The fingerguard 110 further includes a pair of front latches 126 for engaging receiving slots of the plug-in outlet base 100 in a snap-fit configuration. The front latches 126 include a retaining end 126*a* for locating the fingerguard 110 in position with respect to the plug-in outlet base 100.

The fingerguard 110 also includes a pair of slots 128 for receiving edges of the leading end of the received stab 106. Each of the slots 128 is defined by a pair of holding bosses 130 for maintaining the stab 106 in mating position.

Figure 3:
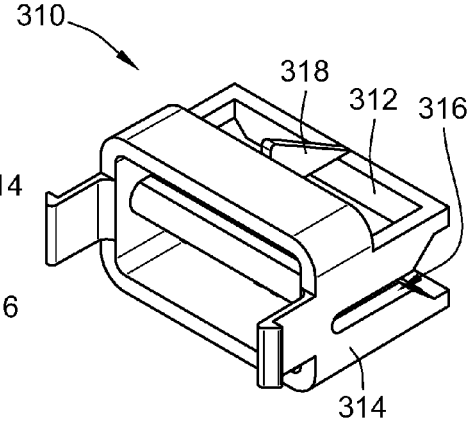
FIG. 3 is a perspective view of a fingerguard, according to another embodiment.

Referring to FIG. 3, a fingerguard 310 is shown in accordance with an alternative embodiment. The fingerguard 310 has a pair of members 312 that extend from parallel side walls 314, and a pair of grooves 316 that are located, respectively, in the side walls 314. The grooves 316 separate the members 312 from each other, providing independent moving of one of the members 312 relative to the other member 312 to achieve a self-adjusting movement of the fingerguard 310 with respect to the stab 106 when necessary (i.e., when positional variations of the stab 106 occur). Each of the members 312 is supported in a central location by a central divider 318. The members 312 function, similar to the back latches 118, to engage a ramp on the received stab 106.

Referring now to FIGS. 4A-4E, the fingerguard 110 engages the plug-in outlet base 100 by positioning the retaining ends 126*a* of the front latches 126 against corresponding base stops 400. As the fingerguard 110 is moved into the opening 104, the retaining ends 126*a* will eventually locate the fingerguard 110 in mounted position with respect to the plug-in outlet base 100 (shown in FIG. 4B). The base stops 400 prevent further movement of the fingerguard 110 into the opening 104.

Figure 4A:
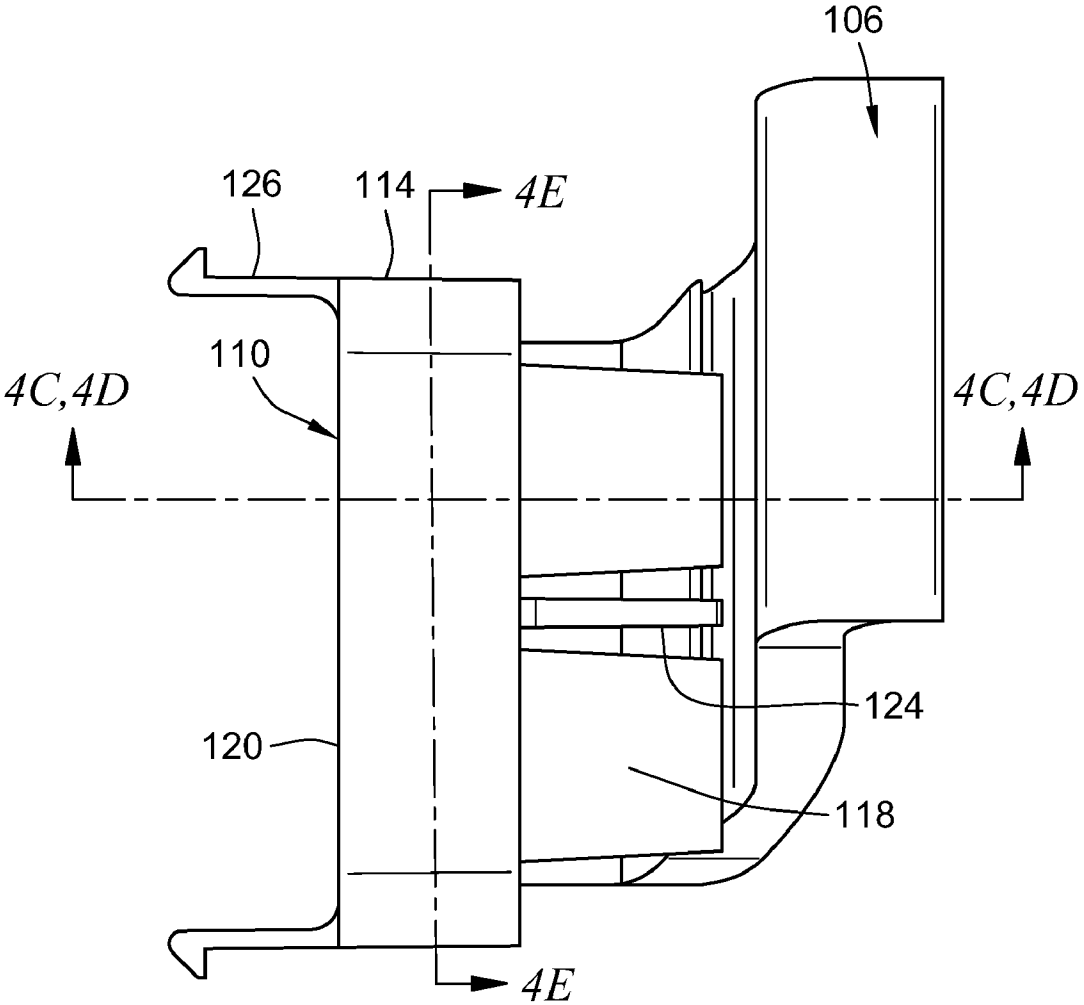
FIG. 4A is a top view illustrating a fingerguard mounted to a corresponding stab.
Figure 4B:
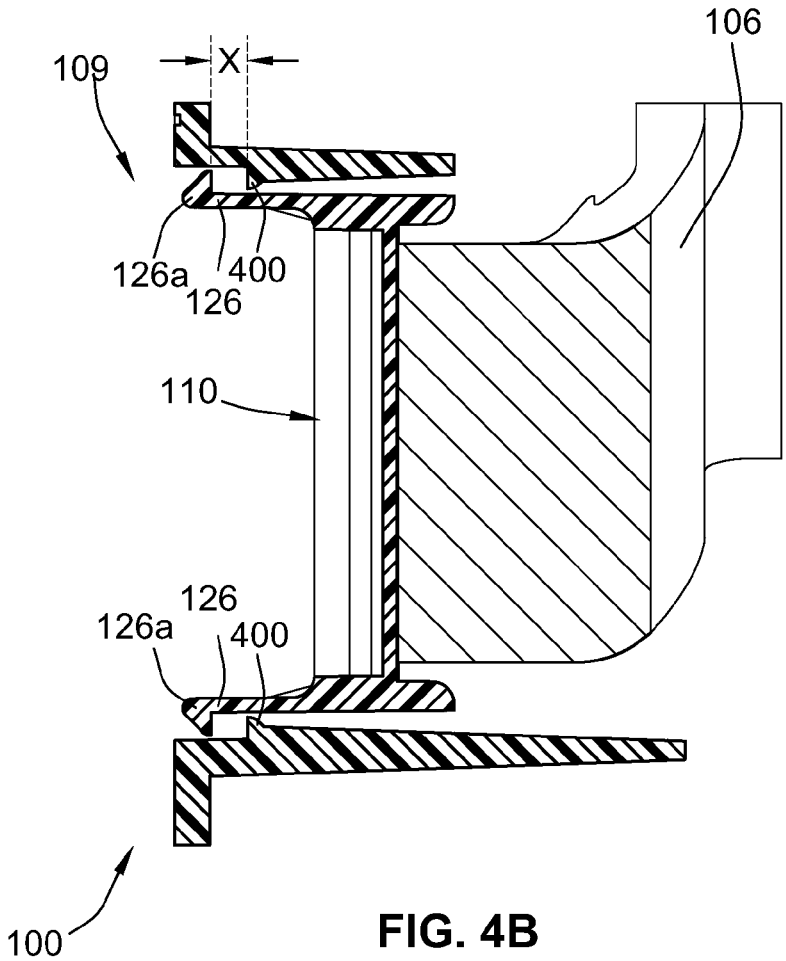
FIG. 4B is a top cross-sectional view illustrating an X clearance between the fingerguard of FIG. 4A and a plug-in outlet base.
Figure 4C:
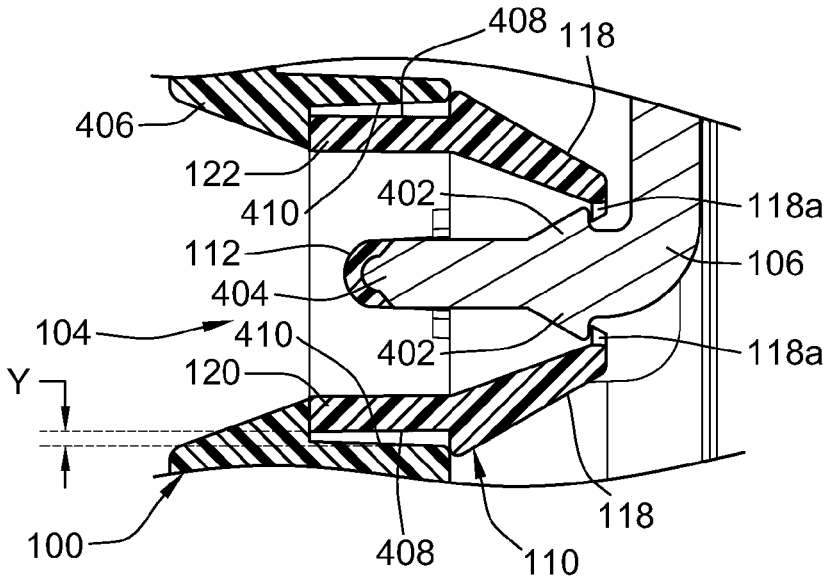
FIG. 4C is a side cross-sectional view illustrating an Y clearance between the fingerguard of FIG. 4A and the plug-in outlet base.

When the fingerguard 110 is mounted, the hooked ends 118*a* of the back latches 118 engage ramped ends 402 of the stab 106 (shown in FIG. 4C). In general, the back latches 118 are flexible such that a sufficient displacement permits each latch 118 to snap over the ramped end 402 when the fingerguard 110 is mounted to the stab 106.

The fingerguard 110 is configured to have one or more "floating" features that accommodate position variations of the stab 106, which are generally caused by manufacturing clearances and/or thermal expansion. The floating aspect is achieved by designed-in clearances, which include one or more of an X clearance, a Y clearance, a Y' clearance, and a Z clearance, as further explained below. It is noted that the X, Y, Y', and Z clearances are not necessarily along traditional axis X, Y, and Z.

The X clearance and the Y clearance allow self-adjustment between the fingerguard 110 and the plug-in outlet base 100. In general, the X clearance accommodates position variations of the stab 106 along a front-to-back direction to allow an in/out float, and the Y clearance accommodates position variations of the stab 106 along a top-to-bottom direction to allow an up/down float.

Referring specifically to FIG. 4B, which illustrates the X clearance, in one direction the base stops 400 of the plug-in outlet base prevent the fingerguard 110 from moving further into the opening 104, and in an opposite direction the ramped ends 402 of the stab 106 helps in preventing the fingerguard 110 from moving away from the opening 104. It is noted, however, that the attachment of the fingerguard 110 to the plug-in outlet base 100 is intended to fix the fingerguard 110 to the stab 106 in an x direction (which is parallel to the direction of the X clearance) and in a y direction (which is parallel to the direction of the Y clearance shown in FIG. 4C). The retaining ends 126*a* of the front latches 126 are positioned at a sufficient distance away from the hooked ends 118*a* of the back latches 118 to permit movement of the fingerguard 110 along the built-in X clearance to accommodate any position variations of the stab 106 caused by manufacturing clearances and/or thermal expansion.

The X clearance permits a front to back or in/out movement of the fingerguard 110 while still maintaining the fingerguard 110 properly mounted relative to the plug-in outlet base 100 and the stab 106, wherein the barrier 112 is properly placed over a leading end 404 of the stab 106 to shield it from contact with the installer's fingers.

Referring specifically to FIG. 4C, which illustrates the Y clearance, the fingerguard 110 is optionally configured to move in a perpendicular direction to the X clearance, along the built-in Y clearance to further accommodate position variations of the stab 106. The top wall 120 and the bottom wall 122 of the fingerguard 110 rest against a corresponding base edge 406 of the plug-in outlet base 100, which are shaped to contour the front portion of the fingerguard 110 and to prevent the fingerguard 110 from moving away from the stab 106. The Y clearance is achieved in part by having the top wall 120 and the bottom wall 122 configured with a proper thickness and position such that they each rest against the corresponding base edge 406 while allowing space (i.e., Y clearance), between parallel faces 408, 410 of the fingerguard 110 and the plug-in outlet base 100, respectively.

The Y' clearance and the Z clearance allow self-adjustment between the fingerguard 110 and the stab 106. In general, the Y' clearance accommodates position variations of the stab 106 along a top-to-bottom direction, and the Z clearance accommodates position variations of the stab 106 along a side-to-side direction.

Figure 4E:
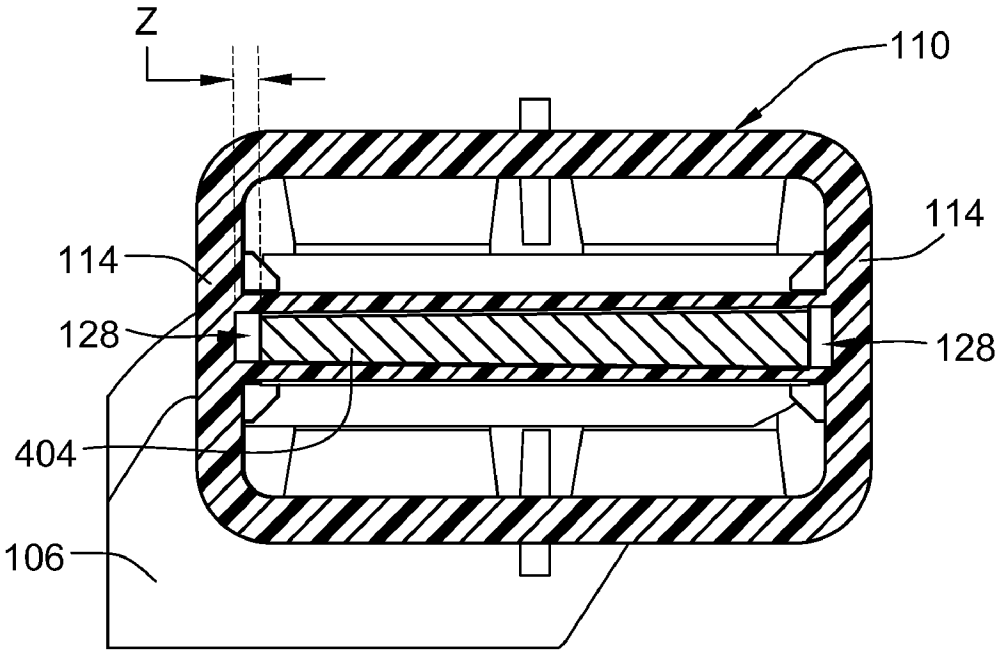
FIG. 4E is a front cross-sectional view of FIG. 4A, illustrating a Z clearance.
Figure 4D:
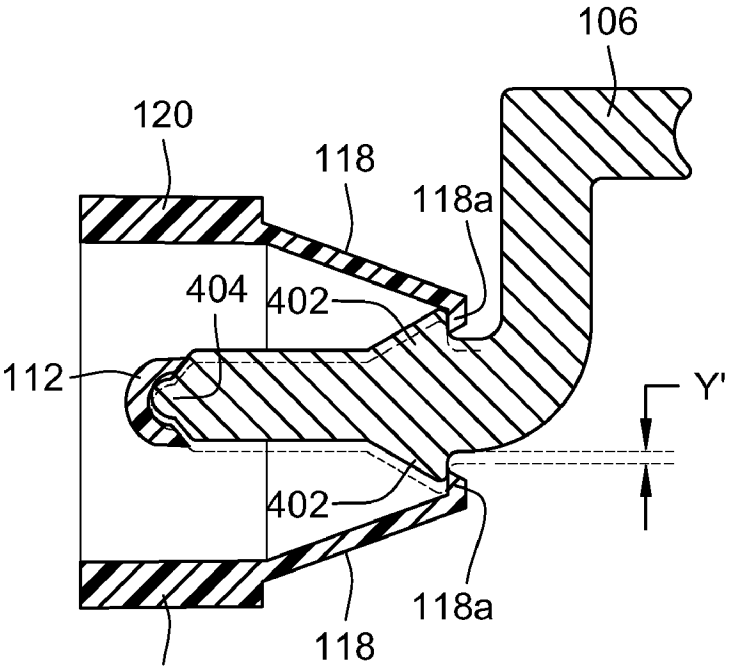
FIG. 4D is a side cross-sectional view of FIG. 4A, illustrating an Y' clearance.

Referring specifically to FIG. 4D, the Y' clearance is facilitated by flexing of the back latches 118, which permit a certain amount of clearance with respect to both the plug-in outlet base 100 and the stab 106. The retaining end 126*a* is movable over the distance Y' and, in the same time, still being engaged to the ramped end 402 of the stab 106. Similar to other clearances, movement of the fingerguard 110 along the Y' clearance occurs while the barrier 112 is properly shielding the leading end 404 and while the fingerguard 110 is properly mounted to both the plug-in outlet base 100 and the stab 106.

Referring specifically to FIG. 4E, the Z clearance is provided by the slots 128 near the side walls 114 of the fingerguard 110. The slots 128 allow movement of the stab leading end 404 relative to the fingerguard side walls 114.

Figure 5:
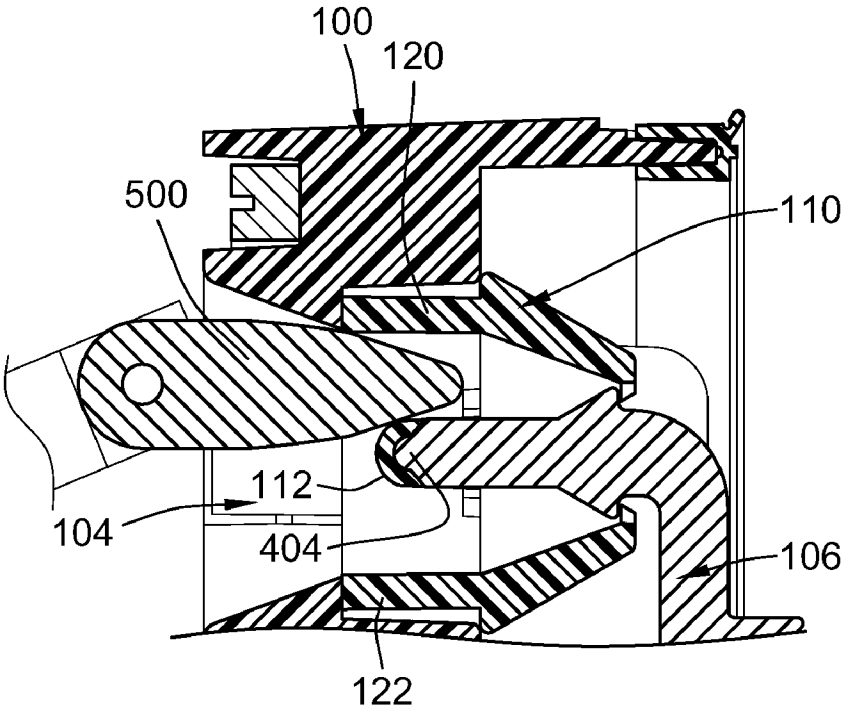
FIG. 5 is a side cross-sectional view illustrating a test finger being inserted in a plug-in outlet.

Referring to FIG. 5, a test finger 500 is inserted into the opening 104 to demonstrate protection feature of the fingerguard 110. As illustrated, the test finger 500 does not make contact with the stab 106, and, in particular, with the stab leading end 404. The fingerguard 110 restricts access to the test finger 500 for preventing contact with the stab 106 regardless of the position of the stab 106.

Figure 6:
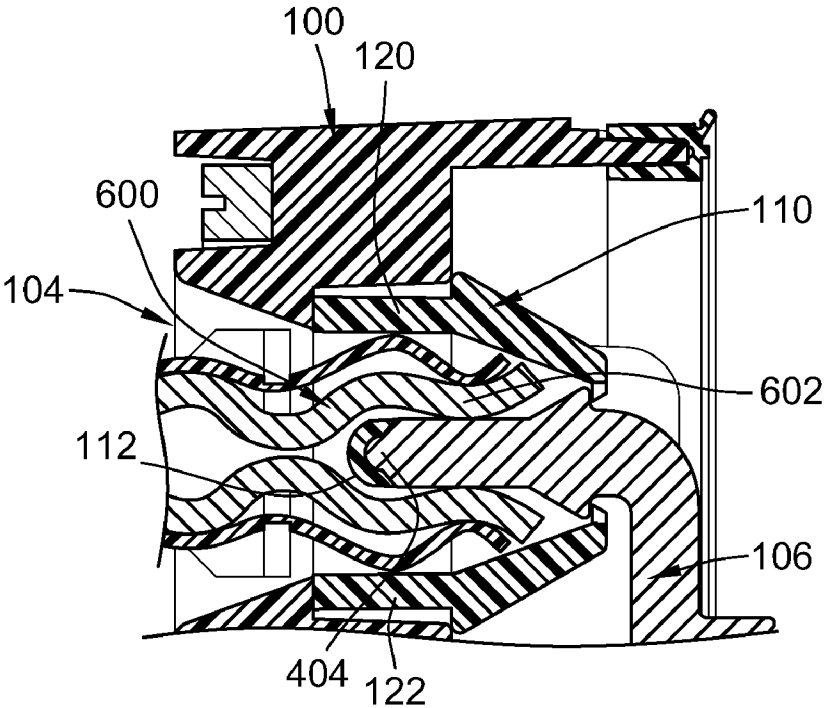
FIG. 6 is a side cross-sectional view illustrating a plug-in unit jaw being mounted to a stab of a plug-in outlet.

Referring to FIG. 6, an electrical jaw 600 is mounted into the opening 104 to the stab 106. A leading end 602 of the jaw 600 is in electrical contact with the stab 106. Thus, the barrier 112 (or any other feature of the fingerguard 110) does not interfere with proper electrical mounting between the jaw 600 and the stab 106.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A plug-in outlet for a busway system, comprising:

a plug-in outlet base mounted to a busway housing and having an opening into which an electrical stab extends from a busbar of the busway system; and a fingerguard mounted to the base into the opening and having self-aligning features achieved by built-in tolerances, the fingerguard having a central barrier for shielding a leading end of the electrical stab, the central barrier extending from side walls of the fingerguard and being separated by respective gaps from a top wall and a bottom wall of the fingerguard, and a top back latch and a bottom back latch for attaching the fingerguard to the stab, the top back latch and the bottom back latch extending from respective ones of the top wall and the bottom wall toward the stab and retaining the stab toward the fingerguard.

2. The plug-in outlet of claim 1, wherein the fingerguard further includes a plurality of front latches for attaching the fingerguard to the base.

3. The plug-in outlet of claim 2, wherein the front latches have retaining ends for resting against respective stops of the base, the distance between the retaining ends and the top back latch and the bottom back latch being such that a front-to-back X clearance is achieved by the fingerguard to accommodate position variations of the stab.

4. The plug-in outlet of claim 2, wherein the front latches extend from respective ones of the side walls away from the stab and retaining the fingerguard from movement toward the stab.

5. The plug-in outlet of claim 1, wherein the top wall and the bottom wall are separated by a distance such that a top-to-bottom Y clearance is achieved between parallel faces of the base and a respective one of the top wall and the bottom wall.

6. The plug-in outlet of claim 1, wherein the top back latch and the bottom back latch are flexible such that a hooked end is movable over a top-to-bottom Y' clearance while the hooked end remains engaged to a ramped end of the stab.

7. The plug-in outlet of claim 1, wherein the side walls of the fingerguards have respective interior slots for receiving the stab, the interior slots having a Z clearance for accommodating position variations of the stab.

8. The plug-in outlet of claim 1, wherein one or more of the top back latch and the bottom back latch are angled toward a ramp surface of the stab.

9. The plug-in outlet of claim 1, wherein the top back latch and a bottom back latch is each separated into a respective pair of independently moving back latches.

10. The plug-in outlet of claim 9, wherein each pair of the two pairs of back latches is separated by a central divider, the central divider being offset from each adjacent back latch of the pairs of back latches.

11. The plug-in outlet of claim 1, wherein the central barrier has an arc-shape, the central barrier having an interior space in which the leading end of the stab rests when mounted in position.

12. The plug-in outlet of claim 1, wherein the plastic material is a Zytel® FR50 material.

13. A plug-in outlet of a busway system with a plurality of self-aligning fingerguards, the plug-in outlet having a base with openings into which a plurality of electrical stabs extend from respective ones of a plurality of busbars, each of the fingerguards comprising:

a plurality of walls, including a top wall, a bottom wall, and a pair of side walls;

a barrier extending internally from the side walls, the barrier being curved such that an internal space is formed to receive a leading end of a mounted stab;

a top aperture and a bottom aperture, the top aperture separating the barrier from the top wall and the bottom aperture separating the barrier from the bottom wall;

a top back latch and a bottom back latch, the top back latch extending from the top wall and being angled toward the mounted stab, the top back latch being flexible to engage and retain a stab ramp by a snap-fit action; and a pair of front latches engaging the base and retaining the fingerguard in position relative to the base.

14. The fingerguard of claim 13, wherein the top aperture and the bottom aperture have a size configured to receive an electrical jaw.

15. The fingerguard of claim 13, wherein, when the fingerguard is mounted to both the base and the mounted stab such that the barrier shields the leading end of the mounted stab, the fingerguard is movable in one or more directions to accommodate position changes of the stab caused by one or more of stab manufacturing tolerances and stab thermal expansion.

16. The fingerguard of claim 15, wherein one of the directions in which the fingerguard is movable is achieved by forming a X clearance between retaining ends of the front latches and respective stops of the base, the length of the X clearance being based on a distance between at least one of the retaining ends of the front latches and a hooked end of the top back latch.

17. The fingerguard of claim 15, wherein one of the directions in which the fingerguard is movable is achieved by forming a Y clearance between the top wall and an adjacent parallel face of the base.

18. The fingerguard of claim 15, wherein one or more of the top back latch and the bottom back latch has a hooked end, one of the directions in which the fingerguard is movable is achieved by forming a Y' clearance between the hooked end and a ramped end of the mounted stab.

19. The fingerguard of claim 15, wherein one of the directions in which the fingerguard is movable is achieved by forming a Z clearance in slots of the sidewalls to permit side-to-side movement between the mounted stab and the side walls of the fingerguard.

20. The fingerguard of claim 15, wherein the fingerguard is made from a plastic material via an injection molding process.

* * * * *